US009382045B2

(12) United States Patent
Wohlgenannt et al.

(10) Patent No.: US 9,382,045 B2
(45) Date of Patent: Jul. 5, 2016

(54) DISPENSING CLOSURE

(75) Inventors: Herbert Wohlgenannt, Schaffhausen (CH); Bruno Königseder, Röhrnbach (DE); Katrin Prinz, Ringelai (DE)

(73) Assignee: Aptar Freyung GmbH, Freyung (DE)

( * ) Notice: Subject to any disclaimer, the term of this patent is extended or adjusted under 35 U.S.C. 154(b) by 0 days.

(21) Appl. No.: 14/390,486

(22) PCT Filed: May 29, 2012

(86) PCT No.: PCT/EP2012/002269

§ 371 (c)(1),
(2), (4) Date: Oct. 3, 2014

(87) PCT Pub. No.: WO2013/178234

PCT Pub. Date: Dec. 5, 2013

(65) Prior Publication Data

US 2015/0108167 A1 Apr. 23, 2015

(51) Int. Cl.

| | |
|---|---|
| ***B65D 43/02*** | (2006.01) |
| ***B65D 47/14*** | (2006.01) |
| ***B65D 47/08*** | (2006.01) |

(52) U.S. Cl.

CPC ..... *B65D 43/0212* (2013.01); *B65D 47/0809* (2013.01); *B65D 47/14* (2013.01); *B65D 2101/003* (2013.01); *B65D 2251/1033* (2013.01)

(58) Field of Classification Search

CPC ..... B65D 2101/0023–2101/0061; B65D 2101/003; B65D 2251/1033; B65D 43/0212; B65D 47/08; B65D 47/0804; B65D 47/0809; B65D 47/14

See application file for complete search history.

(56) References Cited

U.S. PATENT DOCUMENTS 4,170,315 A * 10/1979 Dubach ..... B65D 47/0814 220/281
4,941,592 A * 7/1990 Kitterman ..... B65D 55/024 215/241
5,356,017 A * 10/1994 Rohr ..... B65D 47/0838 215/216

(Continued)

FOREIGN PATENT DOCUMENTS

EP 1502871 A2 2/2005
GB 2401859 A 11/2004

(Continued)

OTHER PUBLICATIONS

International Search Report and Written Opinion for corresponding PCT Application No. PCT/EP2012/002269 mailed Mar. 1, 2013.

*Primary Examiner* — Nicholas J Weiss

(74) *Attorney, Agent, or Firm* — Wood, Phillips, Katz, Clark & Mortimer

(57) ABSTRACT

The present invention relates to a dispensing closure comprising a base and a cover being attached to said base by a hinge and being movable between an opened and a closed position, said cover comprising an outer side-wall, wherein said dispensing closure also comprises tamper evident elements indicating whether said cover had been opened or not. The tamper-evident elements comprise a first latch element and a second latch element engaging with each other when said cover is in its closed position The cover comprises a push-button region being arranged such that when being pushed by a user at least partly in a radial inward direction, the first latch element will be brought out of engagement with said second latch element.

15 Claims, 5 Drawing Sheets

(56) References Cited

U.S. PATENT DOCUMENTS

| | | | | |
|---|---|---|---|---|
| 7,798,348 | B2 * | 9/2010 | Sawyer | B65D 47/0809 215/237 |
| 8,141,731 | B2 * | 3/2012 | Mazurkiewicz | B65D 47/0814 215/237 |
| D665,261 | S * | 8/2012 | Mazurkiewicz | D9/449 |
| 8,413,832 | B2 * | 4/2013 | Mazurkiewicz | B65D 47/0804 215/235 |
| 8,733,566 | B2 * | 5/2014 | Druitt | B65D 47/0809 215/237 |
| 2006/0090671 | A1 * | 5/2006 | Ekkert | B65D 47/0847 106/439 |
| 2006/0273062 | A1 * | 12/2006 | Delage | B65D 47/0814 215/237 |
| 2008/0047976 | A1 * | 2/2008 | Scheer | B65D 47/0809 222/153.06 |
| 2009/0194501 | A1 | 8/2009 | Yamanaka et al. | |
| 2010/0264145 | A1 * | 10/2010 | Benoit-Gonin | B65D 47/0838 220/265 |
| 2011/0100990 | A1 | 5/2011 | Clodfelter et al. | |
| 2012/0067922 | A1 * | 3/2012 | Benoit-Gonin | B65D 47/0857 222/153.06 |
| 2014/0034663 | A1 * | 2/2014 | Konigseder | B65D 47/0804 220/835 |
| 2014/0224802 | A1 * | 8/2014 | Gonnert | B65D 47/0814 220/265 |
| 2014/0346172 | A1 * | 11/2014 | Banerjee | B65D 47/0809 220/257.1 |

FOREIGN PATENT DOCUMENTS

| | | | |
|---|---|---|---|
| WO | 2007134755 | A1 | 11/2007 |
| WO | 2009145847 | A1 | 12/2009 |
| WO | 2010004486 | A1 | 1/2010 |

* cited by examiner

DISPENSING CLOSURE

FIELD OF THE INVENTION

The present invention relates to a dispensing closure, which can be attached to a container, while such containers are arranged for storing a fluid or another flowable medium, which can be dispensed through an opening of the dispensing closure.

BACKGROUND OF THE INVENTION

Furthermore, dispensing closures with a tamper-evident element are known, which indicate when the dispensing closure had been partly or fully opened, in order to indicate to the user that the container has, at least partly, been opened.

Such tamper-evident elements are typically realized by a pull element or a pull-tap lid, such that the user can tear off such pull element or pull-tap lid or such that it is torn off automatically when removing the dispensing closure or when opening a cover of such a dispensing closure.

The present invention especially relates to a dispensing closure comprising a base and a cover, being attached to said base by means of a hinge and being movable between an opened and a closed position, while such dispensing closures are frequently referred to as flip-top closures.

BRIEF SUMMARY OF THE INVENTION

It is an object of the present invention to provide an enhanced dispensing closure, being especially suitable for so-called wet aseptic applications, during which the dispensing closure is treated in an immersion bath, typically in acetic acid, in order to make the closure aseptic before use.

This object is solved by a dispensing closure according to claim 1, while claims 2 to 15 relate to specifically advantageous realizations of the dispensing closure according to claim 1.

According to the present invention, the dispensing closure comprises a base and a cover, being attached to said base by a hinge and being movable between an opened and a closed position, wherein said cover comprises an outer side-wall. Furthermore, said dispensing closure also comprises tamper-evident elements, while the term "tamper-evident elements" relates to one or more elements, which, either in combination or together with other elements, realize a tamper-evident function.

According to the present invention, the tamper-evident elements comprise a first latch element which is attached to a first region of the inner side of said outer side-wall of said cover and which is movable from a locking position to an unlocking position, and a second, preferably fixed latch element being attached to said base, wherein said first and said second latch element are arranged and positioned such that they engage with each other when said cover is in its closed position and when said first latch element is in its locking position.

In this respect it has to be noted that the dispensing closure can be manufactured either in an opened or in a closed position. In those cases where the dispensing closure has been manufactured in an open position, it will be closed for the first time before being put into use, while in such cases said first and said second latch element engage with each other after the first closing and before being put into use.

According to the invention, the outer side-wall of said cover also comprises a push-button region or area. Said push-button region extends about a part of the area defined by said outer side-wall of said cover.

Furthermore, said push-button region is connected to the remaining area of said outer side-wall, while this connection is realized at least partly by at least one indicator element, preferably a predetermined breaking element, e.g. by at least one or preferably two bars connecting said push-button region with the remaining or adjacent or surrounding area of said outer side-wall of said cover.

Said at least one indicator element is arranged such that said push-button region can be pushed by a user at least partly in a radial inward direction such that at least one indicator element can be destroyed or deformed and said first latching element can be brought out of engagement with said second latching element.

A broken or deformed indicator element is clearly visible to a user from outside, so that a broken or deformed indicator element shows that the closure has been tampered with or has been opened or at least partly opened by a user.

The dispensing closure according to the present invention has the advantage that the tamper-evident elements are integrated into the other elements, especially integrated into the closed space defined between said cover of the dispensing closure and said base, so that no tear-off element or separate element, projecting from the other elements of the closure, is necessary, which could harm or destroy the outer appearance of the dispensing closure or which can be or has to be separately torn off by the user, either on purpose or inadvertently.

Said at least one indicator element can be realized by utilization of a deformable material, or can be alternatively realized by a predetermined breaking element, i.e. by an element, being not only visibly deformed but being destroyed after the cover has been opened or partly opened for the first time.

The dispensing closure according to the present invention with said push-button region being integrated into the cover of said dispensing closure and with the first latch element being integrated inside the cover, therefore neither visible nor extending out of a protected space created between cover and base when said dispensing closure is in its closed position, especially enables the dispensing closure to be used for wet aseptic applications, during which such a dispensing closure is immersed in an aseptic liquid, typically acetic acid, as in these cases no acetic acid (or alternative liquids) can enter into the protected space between cover and base, furthermore the dispensing closure can be designed such that it has an essentially smooth outer surface, preventing that acetic acid remains in openings, recesses or other covered or "protected" areas on the outside of said closure.

According to a preferred embodiment, the push-button region is connected, at its circumferential area or rim, to the remaining area of said outer side-wall by at least one indicator element, while the other parts of said circumferential area are connected to said outer side-wall either by the same material, possibly or even preferably having a thinner wall-thickness, or by another material, preferably by a softer or more elastic material.

This realization has the advantage that the push-button region can be pushed in, at least partly radially, by a user, leading to a breaking or deforming of said at least one indicator element, while in other areas the push-button region may still be connected to the remaining area of said outer side-wall, possibly without any visible deformation.

According to a preferred embodiment of the dispensing closure said first latch element is attached to the push-button region, especially attached at the inner side of the push-button region. This has the advantage that the first latch element is moved directly, preferably at least partly in a radially inward direction, when said push-button region is pushed by a user, leading to a very reliable decoupling of said first and said second latch element.

According to a further preferred embodiment, said push-button region has an outer contour essentially in the form of a ring, especially a circular or an oval ring. This has the advantage that the push-button region can be adapted in its form essentially to a finger or a tip of a finger of a user, so that the user can easily push the push-button region essentially without influencing surrounding areas of the cover. Alternatively, the outer contour of the push-button region can also have different forms, i.e. a rectangular or triangular form.

Preferably the push-button region can comprise a logo or a wording like e.g. "push" or "press", in order to give easily understandable instructions to the user for opening the dispensing closure.

According to a preferred embodiment, the dispensing closure comprises at least one, preferably two indicator elements, preferably two predetermined breaking elements and an intermediate connecting area between the push-button region and the directly adjacent area or areas of the cover, while further preferably the material of said intermediate connecting area is made from a different material than the rest of the closure, preferably made of a more elastic or softer material than the material of the cover of the dispensing closure. Due to the higher softness or higher elasticity of the intermediate connecting area, this intermediate connecting area can maintain intact, although the push-button region is pushed at least partly inside in a radial inward direction by the user and although the indicator elements are destroyed or deformed.

This has the advantage that the push-button region is not detached from the cover, which makes recycling easier, furthermore, still the cover of the dispensing closure maintains a good-looking outer appearance, while no protruding elements are disturbing this appearance or cause possible injuries or undesired or unpleasant feelings to the user touching the closure.

According to another, even independently inventive aspect, the dispensing closure comprises a sealing area, preferably a sealing ring, at a lower rim of said cover, preferably being made of a different material than the material of the cover, especially preferably made from a softer or more elastic material than the material of the cover and/or the base of the dispensing closure. This sealing area or ring realizes a tight sealing of the cover and the base, especially an upper area of said base, so that the space defined between said cover and said base, when said cover is in its closed position, is sealingly protected from the outside. This sealing area has the advantage that in case the dispensing closure is, in its closed position, immersed into an aseptic liquid, like acetic acid, no acid can enter into the space defined between cover and base. This is especially important as it is extremely difficult to remove acid from this space, if such acid has entered this space one, while, however, it must of course ensure that no acid or aseptic liquid remains in or at the closure before further use.

According to an especially preferred embodiment, the cover comprises, at its inner side and preferably at a top and preferably at a center area of said cover a protrusion, preferably a ring-like protrusion, which at least partly extends into a dispensing opening of the closure when said cover is in its closed position, such that it seals the dispensing opening of the closure. This specific realization has the advantage that there is no possibility for an aseptic liquid, like acetic acid, to enter into the space created between cover and base, especially an upper side of said base, not even through the dispensing opening, so that the space generated between an inner side of said cover and an upper side of said base is tightly sealed in all directions to the outside.

This specific embodiment thereby realizes a dispensing closure being perfectly suited for wet aseptic applications.

According to a further preferred embodiment, said first and said second latch element are arranged such that, when being in engagement, said cover is, due to the engagement and interaction of the two latch elements, pulled onto said base with a predetermined force, in order to realize a more secure sealing between the rim of the cover and the upper area of said base. Preferably such force is at a level such that said sealing area, preferably said sealing ring, being made of a softer or more elastic material than the material of the cover and/or the base of the dispensing closure, is at least partly compressed. This even more enhances the tight sealing between the rim of said cover and the upper area of said base.

According to a preferred embodiment, the material of said sealing area and the material of said intermediate connecting area is identical, while in a further preferred embodiment, the sealing area and the intermediate connecting area are connected with each other. This has the advantage that the manufacturing of the closure can be especially easily and reliably realized by bi-injection moulding.

According to a preferred embodiment the dispensing closure also comprises a dome-shaped spout, which is preferably arranged such that the dome-shaped spout extends beyond an upper area of said base, while preferably the spout shape and/or the shape of the base, especially the upper area of the base, is ergonomically formed to fit to the form of a mouth of a user, who uses the dome-shaped spout for drinking from a container to which said dispensing closure is attached.

According to a further preferred embodiment, the first latch element comprises a longitudinally extending bar element, which at one end or in the area of one end is connected to an inner side of said cover, while at the opposite end or close thereto, or, in an alternative embodiment, somewhere over the longitudinal extension of said first latch element, a hook is provided for an engagement with said second latch element.

Such an arrangement does provide a very reliable functioning of the tamper-evident elements, a secure engagement of the first and the second latch element, when said first latch element is in its locking position, especially before a first opening of the cover, and also a secure and reliable detachment and bringing out of an engagement of the two latch elements when a pressure is applied by a user onto the push-button region.

Especially the attachment of the first latch element at one end of its longitudinal extension enables a, preferably at least partly rotational, movement of the hook, so that the pushing of the push-button region by a user over a certain distance d leads to a movement of the hook over a distance D, with D>d.

Preferably the second latch element is realized by a clearance or by an opening provided at said base, preferably at an upper region and/or an outer region or rim region of said base, covered by at least one bridging element, bridging at least parts of said recess or clearance. This enables a reliable engagement and dis-engagement of the first latch element with the second latch element, and it especially enables that all tamper-evident elements are realized at an inner side or space of said dispensing closure, which is especially important when using such a dispensing closure in wet aseptic applications, as referred to above.

In a preferred embodiment of the dispensing closure, the tamper-evident elements, especially, e.g. said first and said second latch element, said push-button region and/or said at least one indicator element, and, if applicable, e.g. an intermediate connecting area are arranged such that said first latch element is biased into said locking position, so that said first latch element moves back into said locking position, when no pressure or force is exerted by the user onto said push-button region.

This realization has the advantage that even after a first opening of said cover, the cover can be closed again by a user, while then automatically said first latch element and said second latch element are brought into engagement, so that the cover is again securely closed. In this respect it of course has to be noted that the indicator element remains destroyed or deformed such that the user can still see that the cover has been opened at least once.

In an alternative realization said tamper-evident elements are arranged such that said first latch element remains in said unlocking position after having been brought once into said unlocking position by a user exerting a force or pressure onto said push-button region. In this alternative realization the cover can still be moved between an opened and a closed position, however it can not be locked into said closed position. Such an alternative may be of advantage in case it should be made even more obvious to a user that the cover has been at least opened once.

In order to enhance this situation, it may be in principle also possible that the cover is arranged such that it is biased in a way that said cover is at least partly moved out of the closed position, if said first and said second latch element are not in engagement with each other.

According to a preferred embodiment, the dispensing closure is made of PE (polyethylene) or PP (polypropylen), while an intermediate connecting area, as referred to above, as well as a sealing area is preferably made of HDPE (high density polyethylene) and/or TPE (thermo-plastic elastomers).

The above-mentioned and further features and advantages of the dispensing closure according to the present invention will become even more apparent in view of the description of preferred embodiments:

DETAILED DESCRIPTION OF THE PREFERRED EMBODIMENTS

Figure 1:
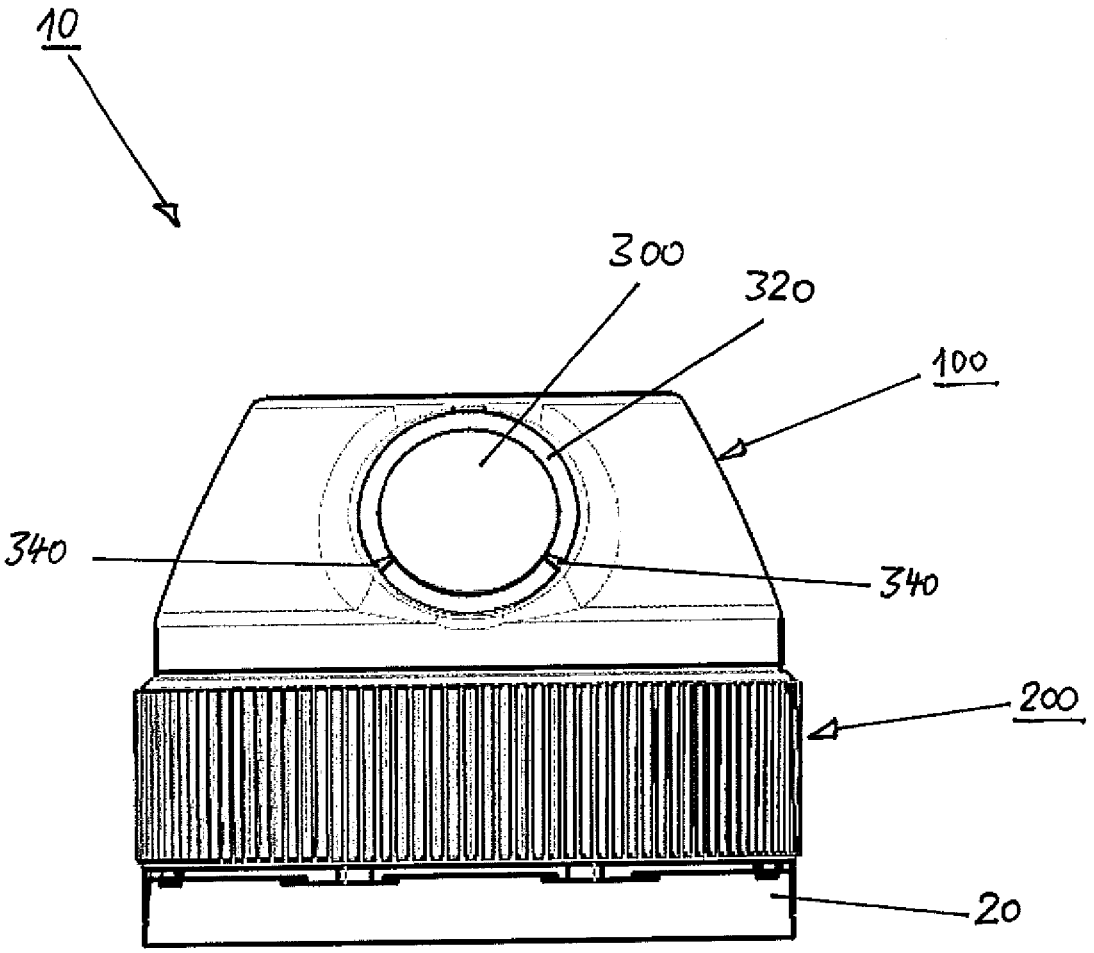
FIG. 1 shows a front view of an embodiment of a dispensing closure according to the present invention.

FIG. 1 shows a front view of a dispensing closure 10 according to the present invention, the dispensing closure 10 comprising a cover 100 and a base 200, while the cover 100 is shown in its closed position.

The dispensing closure 10 as shown in FIG. 1 comprises a tamper-evident element 20, which indicates whether the dispensing closure as a whole has been taken off from a corresponding container. In this respect it has to be noted that the dispensing closure 10 according to the present invention also comprises tamper-evident elements according to the present invention which indicate an opening or partial opening of the cover 100 relative to the base 200, and these tamper-evident elements according to the invention will be described in more detail hereinafter.

The cover 100 of the dispensing closure 10 comprises a push-button region 300, being connected to the remaining area of said outer side-wall of said cover by two indicator elements 340, while additionally the dispensing closure 10 comprises an intermediate connecting area 320, which surrounds the push-button region 300 and is positioned between said push-button region 300 and the remaining area of said cover 100, with the exception of said indicator elements 340.

With respect to the functioning of the push-button region and the tamper-evident elements, it is especially referred to FIGS. 4 and 5 and the corresponding description hereinafter.

Figure 2:
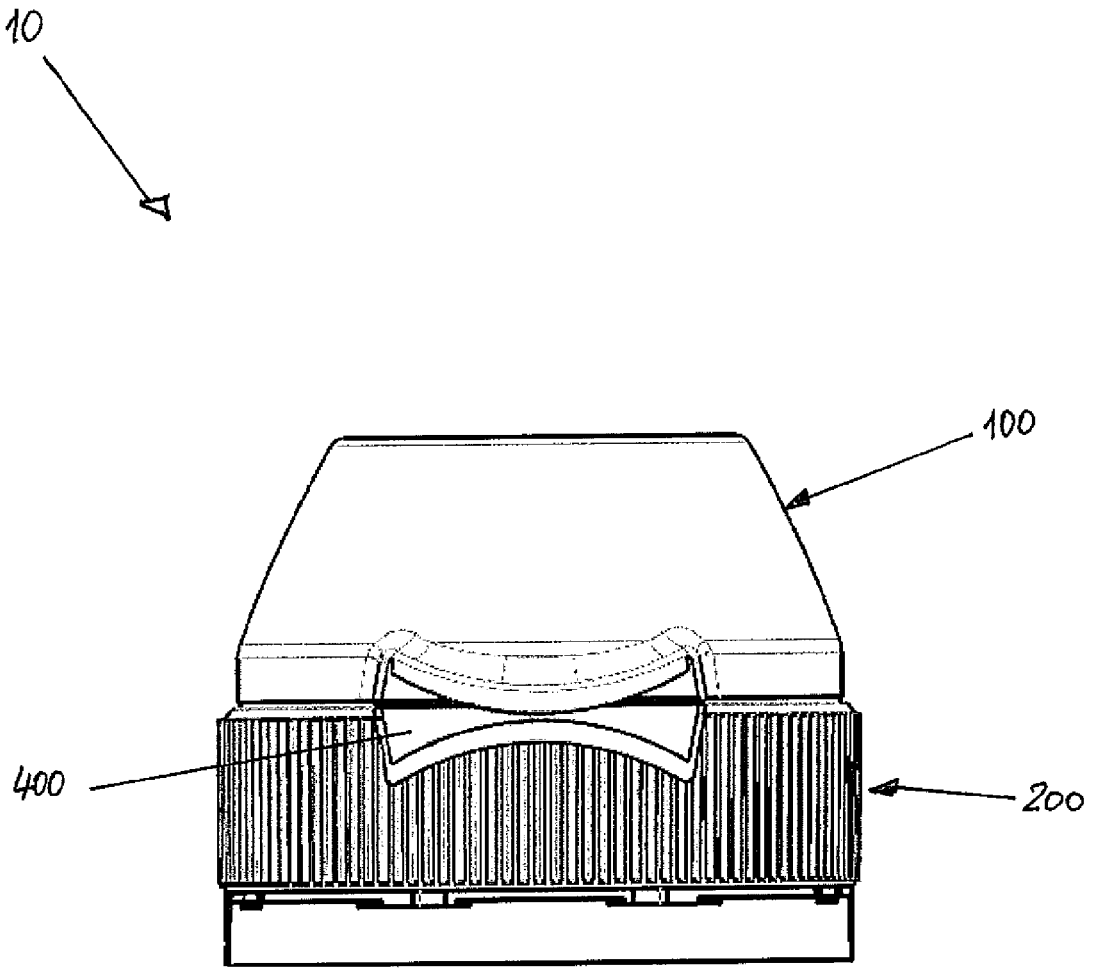
FIG. 2 shows a rear view of an embodiment of the dispensing closure according to the present invention.
Figure 3:
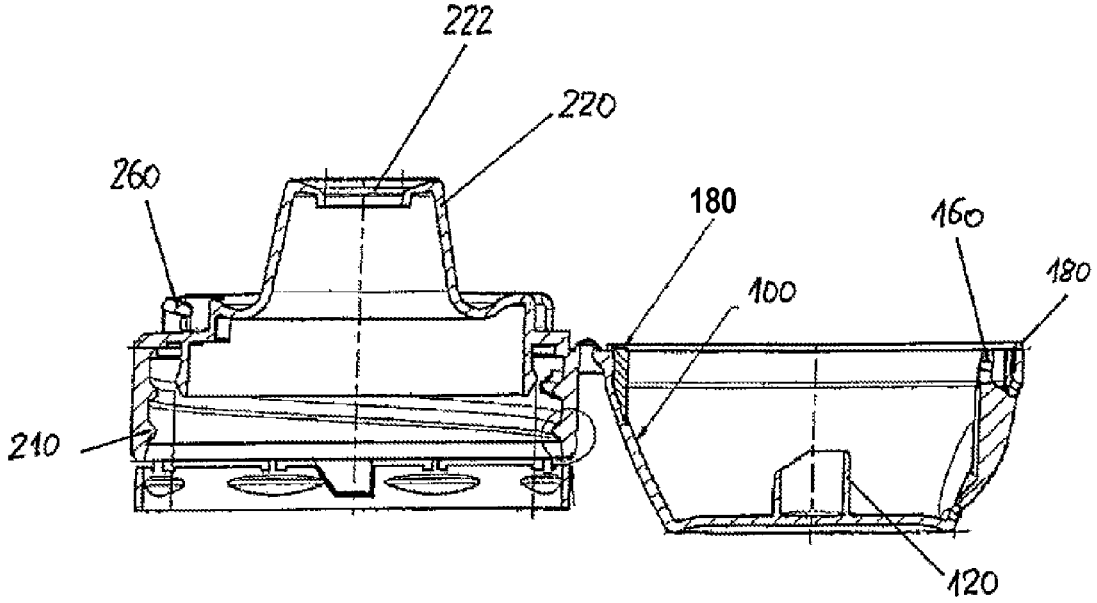
FIG. 3 shows a schematic cross-section through an embodiment of a dispensing closure of the present invention with the cover being in its opened position.

FIG. 2 shows a rear view of an embodiment of the dispensing closure with a cover 100 and a base 200, while said cover 100 is attached to said base 200 by means of a hinge 400, and the cover 100 can be rotated via said hinge 400 from a closed position, as shown in FIG. 2, into an open position, see e.g. FIG. 3.

FIG. 3 shows a cross section through an embodiment of a dispensing closure 10 with the cap 100 being in its open position.

The base 200 has, at its outer side-wall, mounting means 210 for an attachment to a container (not shown), while said mounting means 210 are realized by an internal thread, so that the base 200 can be threaded onto a corresponding outer thread of a respective container.

The base 200 has, at its upper area, an essentially dome-shaped spout 220 with a dispensing opening 222.

When the lid 100 is in its closed position, an essentially circular or ring-like protrusion 120, being provided at the inner side of said cover 120, engages into said opening 222, so that said opening 222 is sealed by said ring-like protrusion 120.

The cover 100 has, at its lower rim area, a sealing area 180, which extends around the complete circumference of the lower rim of said cover 100, thereby having the form of a ring, in this case a circular ring, and which comes into contact with an upper area of said base 200, when said cover 100 is in its closed position.

Thereby, the sealing area 180 securely seals the rim area of said cover 100 to said base 200, so that the space defined between the cover 100 and the base element 200 is securely sealed against the outside by an interrelationship between said sealing area 180 and said base 200 on the one hand and by said rim-like protrusion 120 and said opening 222.

Figure 4:
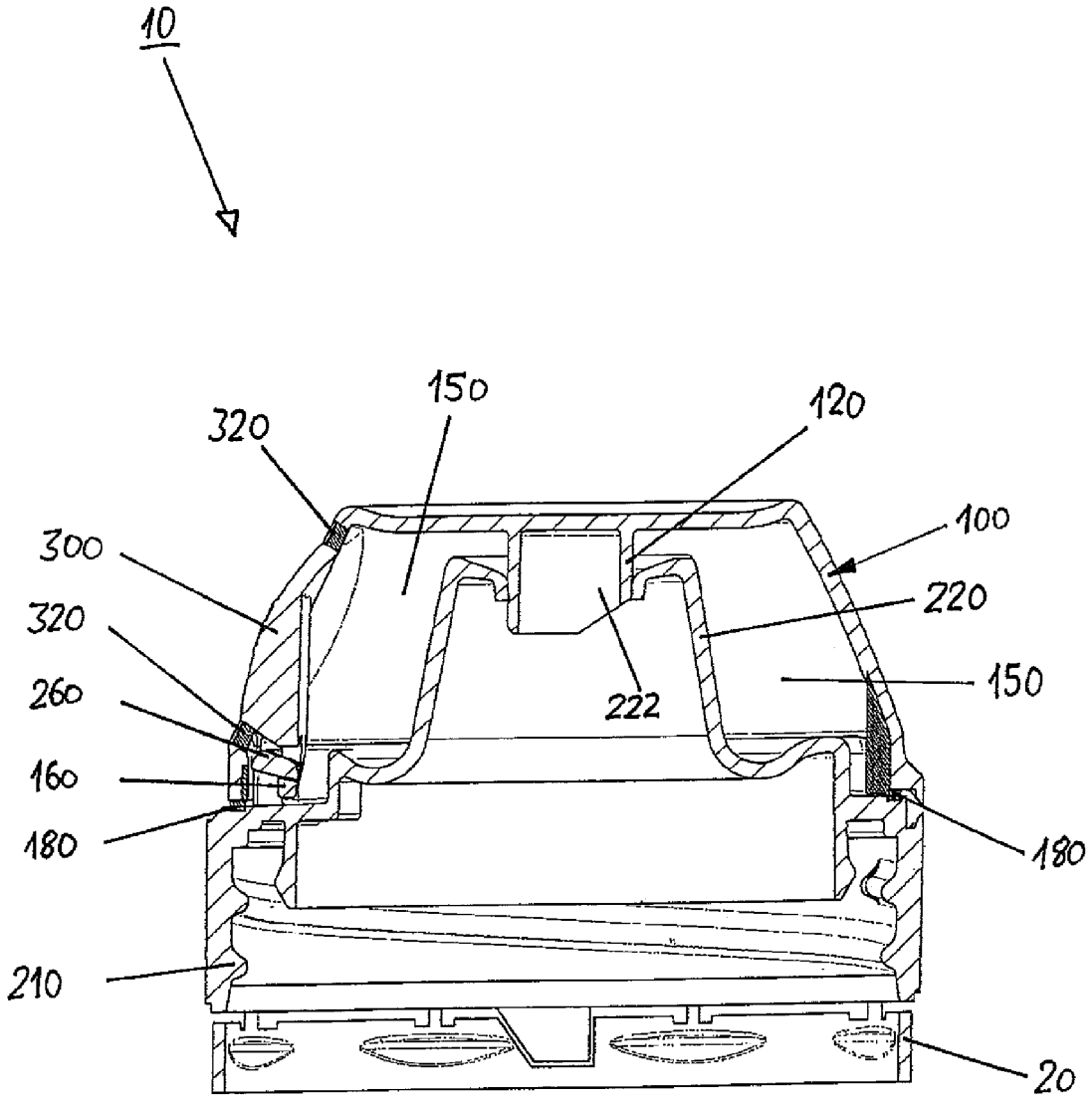
FIG. 4 shows a schematic cross section through an embodiment of a dispensing closure according to the present invention with the cover being in its closed position before first opening by a user.

The cover 100 also comprises a first latch element 160, which has an essentially longitudinal form and which is attached to a first region of the inner side of said outer side-wall of said cover, while said base 200 comprises a second latch element 260, while the first latch element 160 and said second latch element 260 are arranged and positioned such that they engage with each other when said cover is in its closed position and when said first latch element is in its locking position, as it is also shown in FIG. 4.

It has to be noted that this embodiment is realized such that said first latch element 160 is biased into said locking position, so that even after a first opening and a follow-up closing of the cover, the first latch element 160 moves back into its locking position, when no pressure is exerted onto said push-button region 300 by a user, so that the cover 100 can not be only brought into its closed position, but can also be locked again.

The functioning of the tamper-evident element and especially of the first latch element 160 and the second latch element 260 are described with respect to FIGS. 4 and 5 hereinafter.

FIG. 4 shows a schematic cross-section through an embodiment of the dispensing closure 10 according to the present invention, while the closure 10 is shown in a situation, when said cover is in its closed position, while no pressure is exerted onto said push-button region 300.

As can be well seen, the first latch element 160 is in its locking position and is engaged with said second latch element 260, so that the cover 100 is tightly kept in its closed position.

Furthermore, a sealing area, essentially in the form of a sealing ring 180, is arranged at and attached to a lower rim of said cover 100 by injection moulding, while in said closed position said sealing ring 180 is tightly pressed onto an upper area of said base 200 of the dispensing closure 10, thereby tightly sealing the lower rim of the cover 100 to the upper area of the base 200 around the complete circumference.

The cover 100 comprises a ring-like protrusion 120, which extends or protrudes, in the closed position of the cover 100, into the opening 222 provided at the spout 220, so that the opening 222 of the spout 220 is sealingly closed by said ring-like protrusion 120 over its complete circumference.

The space 150 defined between said cover 100 or said inner side of said outer side-wall of said cover 100, and an upper area of said base 200, including said spout 220, is thereby, in the closed position of the cover 100, sealingly closed to the outside.

When therefore treating said closure 10 in an immersion bath, e.g. in acetic acid, for a wet aseptic application, no liquid at all can enter into the space 150 between cover 100 and base 200, ensuring that no wet aseptic liquid like acetic acid will, in spite of cleaning after the immersion bath, remain at such covered areas of the closure. Such a closure as shown in FIG. 4 is therefore especially of advantage and perfect for wet aseptic applications.

Figure 5:
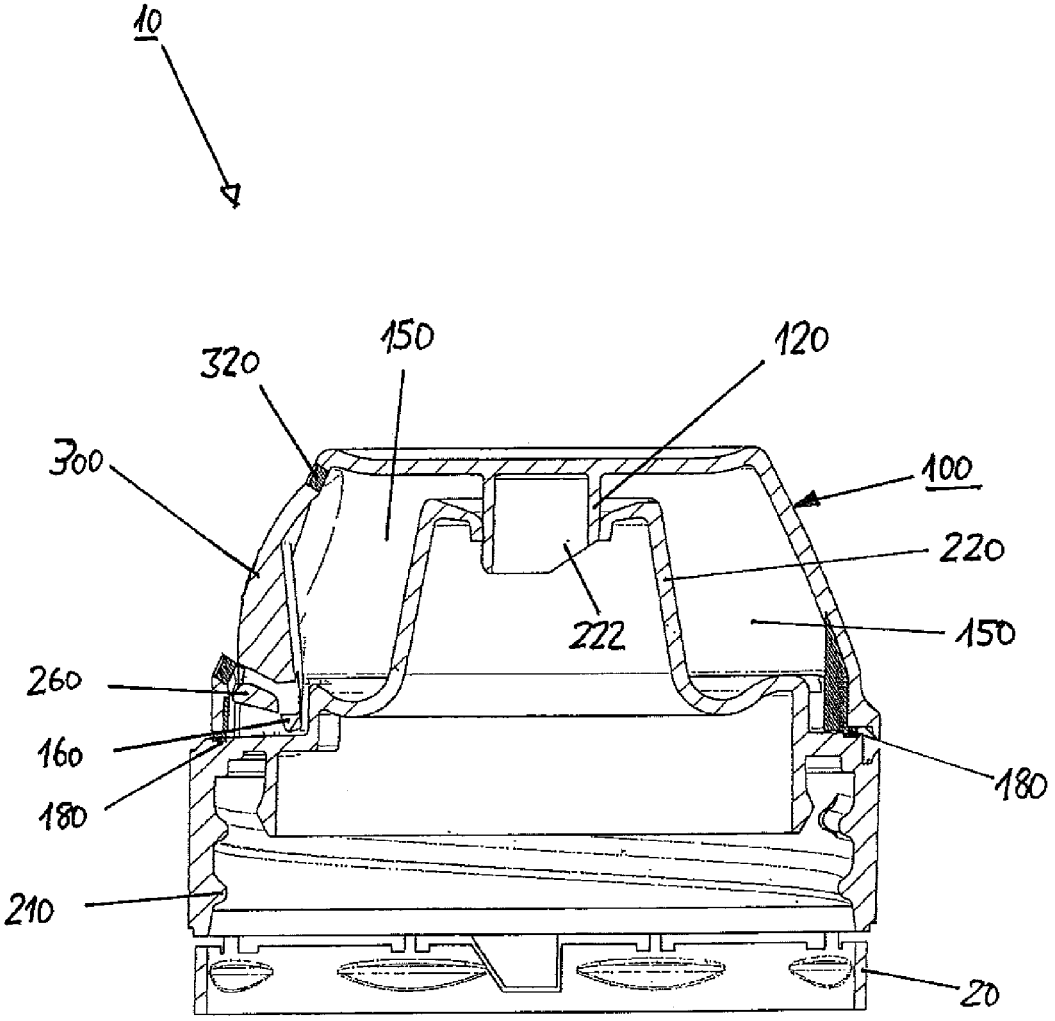
FIG. 5 shows a schematic cross section through the embodiment of the dispensing closure as shown in FIG. 4 after the push-button region has been pressed by a user.

FIG. 5 shows the embodiment as shown in FIG. 4, however, in a situation when pressure is exerted by a user onto the push-button region 300.

It has to be emphasized that FIG. 5 is only a schematic drawing, visualizing the function especially of the first and second latch element and the interrelationship between these two elements, but FIG. 5 does not show the exact structure of the cover and especially the push-button region 300 after having been pushed in by a user.

As can be well seen, the push-button region 300, after having been pushed by a user, is at least partly moved radially inward, so that the first latch element 160, being attached to said push-button region 300, is also at least partly moved radially inward and moves therefore out of engagement with the second latch element 260.

The indicator elements (340, not visible in FIG. 5), are broken or deformed, however, the intermediate connecting area 320, being made of TPE is preferably not visibly deformed or even destroyed, as being made of a more flexible material.

As can be further well seen in FIG. 5, all elements, including all elements which directly or indirectly belong to said tamper-evident elements, are still attached to the remaining parts of the closure 10 and do not protrude into an outside area. Thereby recycling is supported, no additional waste, being separated from the rest of the closure, is generated, and no protruding elements do negatively influence the haptic properties of the closure 10.

It is clear to the expert that various amendments can be made to the embodiment, without departing from the scope of the present invention as defined by the attached claims, and any features disclosed in connection with the embodiments or the general description can be important for realizing the invention, either alone or any combination thereof.

What is claimed is:

1. A dispensing closure (10) comprising a base (200) and a cover (100), attached to said base (200) by a hinge (400) and being movable between an opened and a closed position, said cover (100) including an outer side-wall, said dispensing closure (10) further comprising:

said outer side-wall of said cover (100) including at least one indicator element (340) and a push-button region (300) which is connected at least partly by said at least one indicator element (340) to a remaining area of said outer side-wall of said cover (100) beyond said push-button region (300);

a first latch element (160) which is attached to said push-button region (300) of said cover (100) and which is movable from a locking position to an unlocking position; and a second latch element (260) which is attached to said base (200), wherein said first latch element (160) and said second latch element (260) are arranged and positioned such that they engage with each other when said cover (100) is in said closed position and when said first latch element (160) is in said locking position, wherein said push-button region (300) is arranged to be pushed by a user at least partly in a radial inward direction such that said first latch element (160) is moved into said unlocking position in which said first latch element (160) is out of engagement with said second latch element (260), while said at least one indicator element (340) is at least one of (1) destroyed and (2) deformed by a movement of said first latch element (160) from said locking position to said unlocking position, and wherein said first latch element (160) is arranged to remain part of said cover (100) in both said locking position and said unlocking position.

2. The dispensing closure (10) according to claim 1, wherein said first latch element (160) is attached to said push-button region (300) at an inner side of said outer-side wall of said cover (100).

3. The dispensing closure (10) according to claim 1, wherein said push-button region (300) has a substantially circular or oval form.

4. The dispensing closure (10) according to claim 1, wherein said push-button region (300) is connected to said remaining area of said outer side-wall of said cover (100) by said at least one indicator element (340) and an intermediate connecting area (320) made of a material being different from a material of said cover (100) of said dispensing closure (10).

5. The dispensing closure (10) according to claim 4, wherein said intermediate connecting area (320) is made of a material being more elastic than the material of said cover (100).

6. The dispensing closure (10) according to claim 4, wherein said cover (100) comprises a sealing area at a lower rim of said cover (100) coming into contact with said base (200) of said closure (10) when said cover (100) is in said closed position, wherein said sealing area is made of a material being different from the material of said cover (100).

7. The dispensing closure (10) according to claim 6, wherein said material of said intermediate connecting area (320) is the same material as the material of said sealing area.

8. The dispensing closure (10) according to claim 1, wherein said dispensing closure (10) is manufactured by way of bi-injection moulding as a unitary piece.

9. The dispensing closure (10) according to claim 1, wherein said cover (100) and said base (200) are arranged such that said cover (100) seals against a corresponding area of said base (200) when said cover (100) is in said closed position, such that an inner space defined by an inner side of said cover (100) and an upper side of said base (200) is sealingly closed to the outside, so that said dispensing closure (10) is suitable for wet aseptic applications.

10. The dispensing closure (10) according to claim 9, wherein said push-button region (300) is connected to said remaining area of said outer side-wall of said cover (100) by said at least one indicator element (340) and an intermediate connecting area (320), said intermediate connecting area (320) and said sealing area are made of the same material and are connected with each other.

11. The dispensing closure (10) according to claim 1, wherein said base (200) comprises a dome-shaped dispensing spout.

12. The dispensing closure (10) according to claim 1, wherein said first latch element (160) comprises a longitudinally extending bar element, which is, at one end, connected to said push-button region (300) and which comprises, at an opposite end, a hook for engagement with said second latch element (260).

13. The dispensing closure (10) according to claim 1, wherein said second latch element (260) comprises one of a clearance and a recess in said base (200) element and a bridging element for engagement with said first latch element (160), said bridging element bridging at least part of one of said clearance and a said recess.

14. The dispensing closure (10) according to claim 1, wherein said cover (100) comprises a sealing area at a lower rim of said cover (100) coming into contact with said base (200) of said closure (10) when said cover (100) is in said closed position, wherein said sealing area is made of a material being different from a material of the cover (100).

15. The dispensing closure (10) according to claim 1, wherein said cover (100) comprises, at said inner side, a ring-like protrusion (120), being arranged and positioned to be at least partly inserted into a dispensing opening (222) when said cover (100) is in said closed position to seal said dispensing opening (222).

* * * * *